United States Patent [19]

Speer

[11] Patent Number: 4,546,713

[45] Date of Patent: Oct. 15, 1985

[54] HEM FOLDING MACHINE

[76] Inventor: Billy L. Speer, P.O. Box 416, Campbellsville, Ky. 42718

[21] Appl. No.: 692,909

[22] Filed: Jan. 22, 1985

[51] Int. Cl.[4] ..... D05B 33/02; D05B 35/02

[52] U.S. Cl. ..... 112/141

[58] Field of Search ..... 112/121.29, 141, 147, 112/142, 143, 152, 153

[56] References Cited

U.S. PATENT DOCUMENTS 4,009,672 3/1977 Rockerath et al. ..... 112/141

4,066,025 1/1978 Speer ..... 112/121.29

4,353,316 10/1982 Brocklehurst ..... 112/141 X 4,464,160 8/1984 Joyce ..... 112/141 X

*Primary Examiner*—Werner H. Schroeder

*Assistant Examiner*—Andrew M. Falik

[57] ABSTRACT

An improvement in the initial folding operation of the hemming machine disclosed in U.S. Pat. No. 4,066,025 by the substitution of a live angular belt extending across the path of advancing overhanging hem material in place of the prior fixed curved guide which led the material to a folded under position.

6 Claims, 6 Drawing Figures

HEM FOLDING MACHINE

BACKGROUND OF THE INVENTION

U.S. Pat. No. 4,066,025 issued Jan. 3, 1978 discloses a semi-automatic hemming machine for folding cloth pieces with the edge folded back within the fold, stitching the folded cloth pieces to form hems, thereon and stacking the stitched hemmed pieces into bundles for further processing. The folding and hemming machine utilizes a conveyor belt for transporting the cloth pieces continuously past stationary folding guide plates, and a pair of synchronized narrow belts engage the folded edge of the material top and bottom to frictionally drive the folded hem through the folding and stitching operations.

At the inception of the folding operation a panel of the material to be hemmed is manually laid on the conveyor belt with the margin of the material to be hemmed overlying the edge of the conveyor by suitable amount sufficient to form the complete hem. As the panel advances, its leading edge is first engaged by the end of an overlying narrow belt located immediately above the marginal edge of a track plate on which the conveyor belt is supported so that the material panel is driven from the underside by the main conveyor belt and from the top by the narrow belt along the marginal edge. The leading edge of the material next engages a stationary curved guide which leads the material to a folded under position preparatory to its engagement from underneath by a lower narrow belt which is led to a lower clearance level by idler rollers to provide an open space for the material to be folded under by the fixed guide.

Such apparatus has been successfully employed commercially for a number of years in forming hems of the type described. However, certain limitations have been encountered with some types of cloth and in the size of hem which can be successfully processed without deflection of the cloth out of position before securely engaged by folder belts which control and clamp the cloth to form the hem.

BRIEF DESCRIPTION OF THE PRESENT INVENTION

It has now been found that replacement of the initial fixed curved guide plate which leads the material to a folded-under position with a moving angularly disposed belt extending from a position laterally outside of the main conveyor belt under the edge and to an end position underlying the main conveyor belt has been found to provide superior initial folding of the material to be hemmed greatly enhancing the types of material and size of hems which may be readily accommodated by the balance of the machine which is constructed in substantial accordance with said prior patent disclosure. Such live belt intercepts the leading edge of any given panel where it extends below the main conveyor and progressively wipes past the underside of the folded material to frictionally lead it upward, forward and laterally of main conveyor movement until firmly engaged by upper and lower narrow belts at the marginal edge of the conveyor. Such angular frictional wiping action continues to present the progressively folded material of the panel to the upper and lower engaging marginal belts in a uniform smooth flow until the complete panel has passed.

DESCRIPTION OF PREFERRED EMBODIMENT

Figure 1:
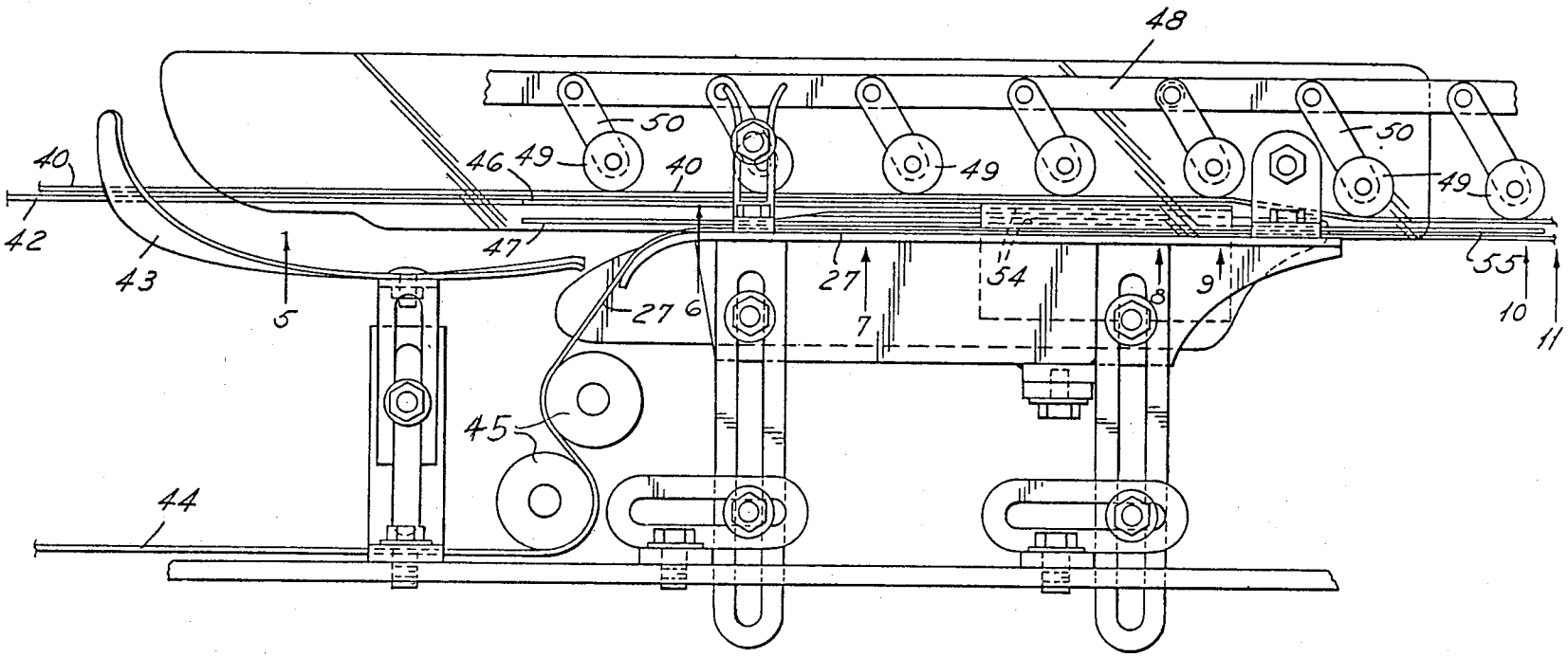
FIG. 1 PRIOR ART
FIG. 1 is a fragmentary side elevation of said prior construction employing the initial fixed curved guide plate (FIG. 2 of said prior patent)

In FIGS. 3–6 identified above certain reference numerals have been applied corresponding to figures of said prior patent in which detailed description may be found. The replacement live belt of the present application, in order to avoid confusion with the earlier patent will be identified by reference numbers in the 100 series.

Figure 2:
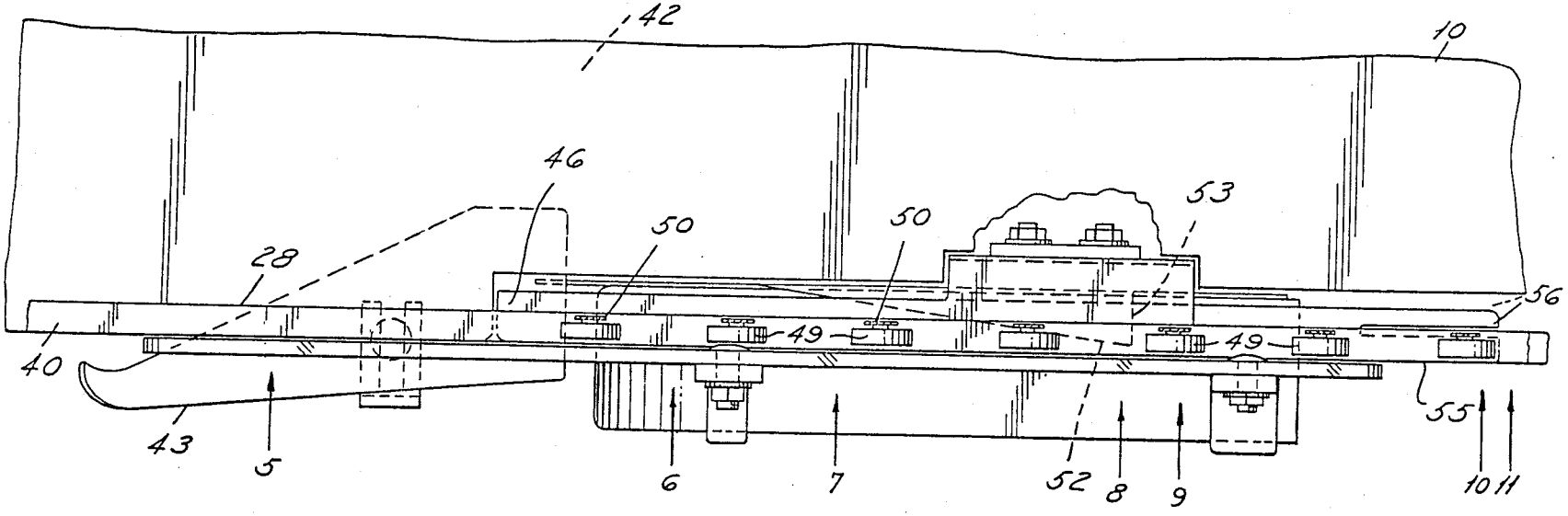
FIG. 2 PRIOR ART
FIG. 2 is a plan view corresponding to FIG. 3 of said prior patent again showing the fixed curved guide plate.
Figure 3:
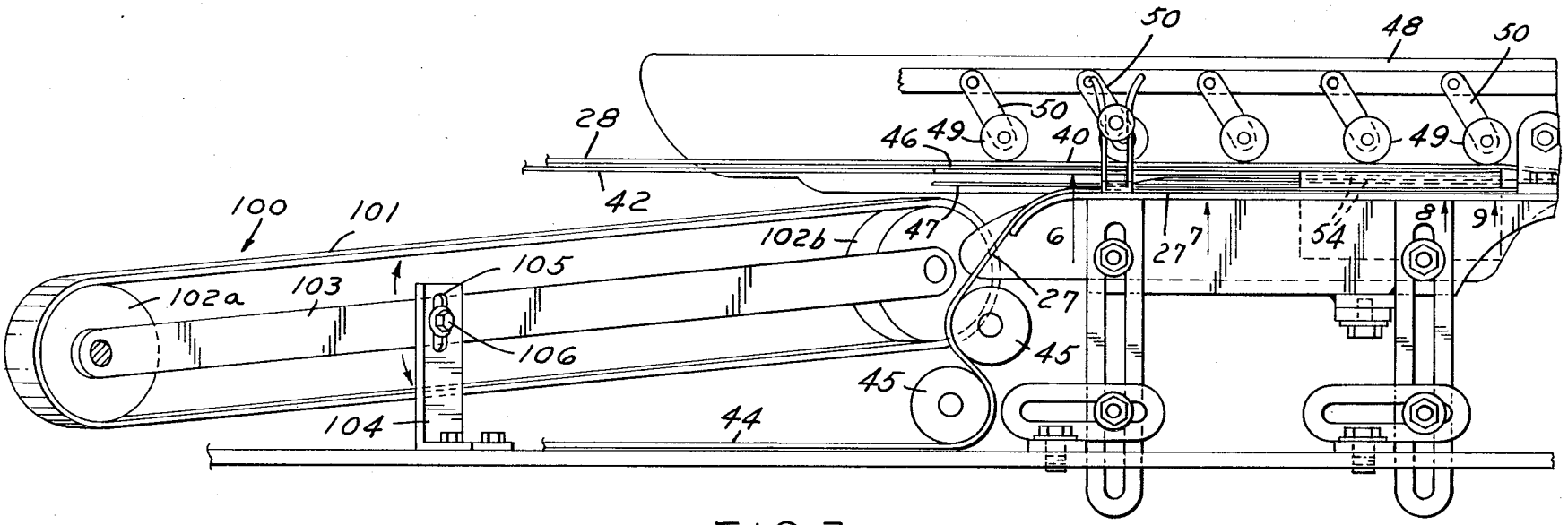
FIG. 3 is a side elevation corresponding to FIG. 1 showing the location of the replacement live belt of the present invention.
Figure 4:
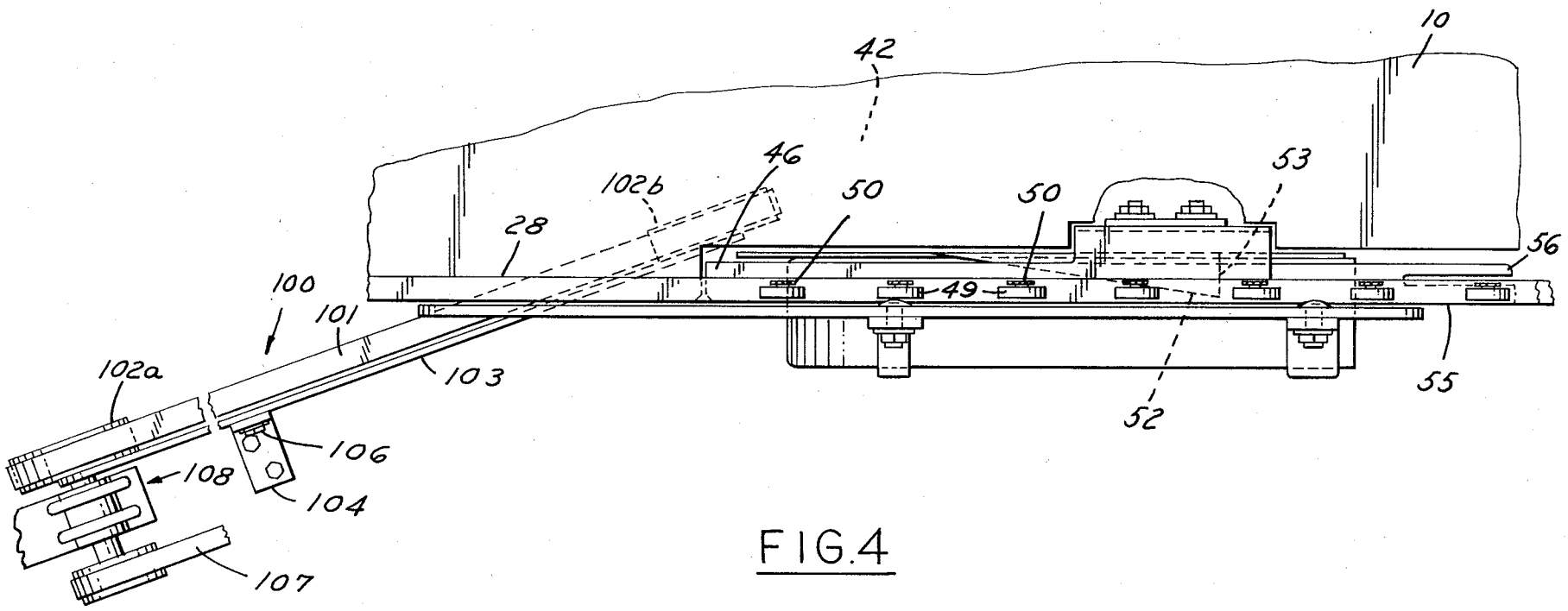
FIG. 4 is a plan view of the present construction of FIG. 3 and corresponding to prior art FIG. 2.

With reference to FIGS. 1 and 2 showing the prior art construction of U.S. Pat. No. 4,066,025, the machine is arranged for manual placement of cloth pieces on a main conveyor belt 10 mounted on a suitable machine frame. Means are provided to drive underlying and overlying narrow belt 28 for engaging the hem of material loaded on main conveyor belt 10. Both narrow belts 27 and 28 as well as main conveyor 10 are all driven at synchronous speed from left to right. A panel of material to be hemmed is manually laid on the conveyor 10 at the left hand end with the margin of the material to be hemmed overlying the edge of the conveyor by a suitable amount sufficient to form the complete hem.

Figure 6:
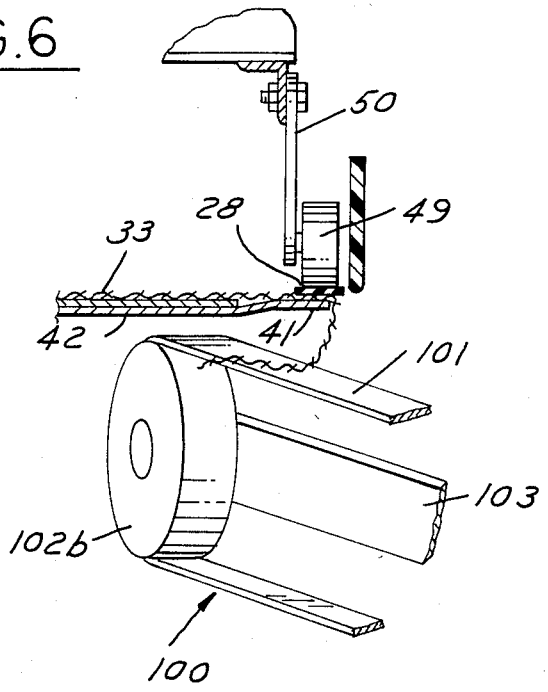
FIG. 6 is a fragmentary sectional end view of the present construction corresponding to FIG. 5 of said prior art patent.

As the panel advances from left to right its leading edge is first engaged by the end of overlying narrow belt 28 which is located immediately above the marginal edge of track plate 42 on which the conveyor belt 10 is supported so that, as shown in FIG. 6, the material panel 33 is driven from the underside by the main conveyor belt 10 and from the top by the narrow belt 28 along the marginal edge 41 of plate 42.

The leading edge of the material next engages curved guide 43 which leads the material to a folded under position preparatory to its engagement from underneath by the lower narrow belt 27 which is led to a lower clearance level 44 by idler rollers 45 to provide an open space for the material to be folded under by guide 43.

An upper fixed guide rail 46 and substantially spaced lower fixed guide rail 47 project along the edge of the conveyor throughout a section extending under an overlying bar 48 on which a series of gravity actuated rollers 49 are pivotally suspended through linkage arms 50. The material 33 after being initially folded passes around the spacing guide rails 46 and 47 as shown in the '025 patent and the lower surface of the material is engaged by the lower narrow guide belt 27 so that the spaced hem portions of the material are frictionally driven under effective control by the narrow lower belt 27 as well as the upper narrow belt 28 urged against the material by the series of weighted rollers 49.

With reference to FIGS. 3–6 illustrating the improvement of the present invention, the initial stage of folding effected by fixed curved guide 43 in applicant's prior machine is now accomplished by a live belt assembly generally indicated as 100. The belt per se 101 extends over pulleys 102*a* and 102*b* rotatably mounted at the ends of bar 103 adjustably mounted as to both angle and elevation on bracket 104 slotted at 105 for attachment bolt 106. A motor driven belt 107 drives a variable speed transmission schematically shown at 108 to provide a variable speed drive for input pulley 102*a* so that the surface speed of belt 101 may be adjusted for optimum operation.

Figure 5:
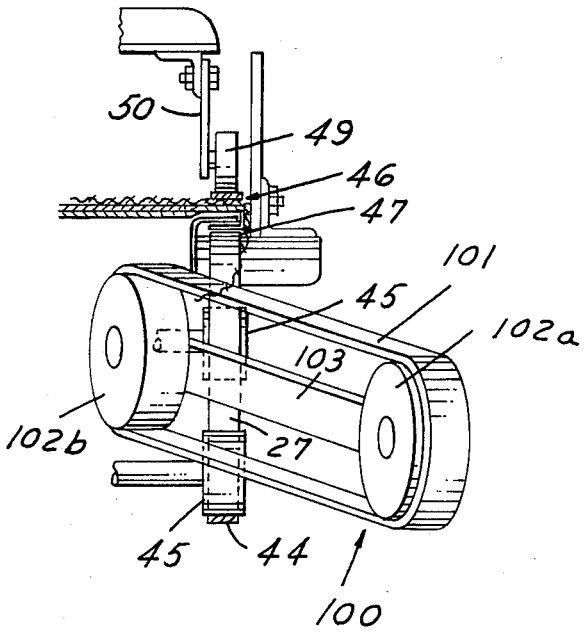
FIG. 5 is an end view showing the replacement belt of FIG. 3.

From the foregoing description it will be understood when the leading edge of material to be hemmed extending under narrow belt 28 and over-hanging the marginal edge 41 of track plate 42 reaches the moving surface of belt 101 it will be progressively folded under as shown in FIG. 5 and raised by the wiping surface of belt 101 as shown in FIG. 6 to accommodate entry under fixed guide rail 47 and engagement by lower narrow belt 27 as required to complete the hem folding operation disclosed in the '025 patent. Instead of the over-hanging material dragging on the fixed curve guide 43 shown in FIGS. 1 and 2 which frictionally resists advance of the material, the active surface 101 of the moving belt serves to urge the material forward and upward as it folds the same to a position where the remaining folding operations may be more effectively and dependably performed.

Whereas the prior construction was employed for hems in the range of one to two inch width and encountered problems with stretch knit as well as slippery fabrics, the improvement of the present live belt accommodates hems ranging up to eight to ten inch width with no problems in hemming any material and with superior uniformity particularly at the lead end of the panel.

We claim:

1. In a hemming machine having conveyor means to continuously convey successive pieces of cloth, progressive folding, tucking and sewing means adjacent said conveyor means adapted to fold and tuck within the fold an edge of each cloth piece preparatory to sewing, said folding and tucking means including spaced guide rails for maintaining a spaced relation between adjacent layers of the hem material, and supplemental tapered guide means extending between said spaced guide means for engaging, folding back and tucking the cloth edge between said adjacent layers, hem engaging conveying means supplemental to and synchronized for movement with the first mentioned conveyor for continuously drivingly engaging opposite outside surfaces of the hem portion of said cloth pieces during passage through said progressive, folding, tucking and sewing means, said hem engaging conveying means including means adjacent the outside surface of each of said guide rails and cooperating with said surface to feed each of said outside hem portion surfaces therebetween, a track plate provided for loading of said successive pieces of cloth with the hem material overhanging said conveyor and track plate on one side, said hem engaging means including an upper endless belt means to engage the upper layer of hem material adjacent said overhanging edge at the beginning of said progressive folding, tucking and sewing means characterized by the improvement of moving guide belt means extending from outside the path of said overhanging hem material angularly relative to and under said endless belt means in spaced relation adapted to intercept the leading edge of each passing cloth piece and to fold it under said conveyor and belt means.

2. The hemming machine of claim 1 wherein said moving guide belt means is provided with an upward slope for raising said hem material as it folds inwardly.

3. The hemming machine of claim 1 including adjustable mounting means for said moving guide belt means to optimize the hem forming operation.

4. The hemming machine of claim 1 including adjustable mounting means for changing the angle and height of said moving guide belt means.

5. The hemming machine of claim 1 including means for adjusting the speed of said moving guide belt means relative to the speed of said conveyor means.

6. The hemming machine of claim 1 including a pair of belt pulleys establishing the path of said moving guide belt means terminating the upper flight of said belt adjacent the entrance of said guide rails.

* * * * *